United States Patent [19]

Swisher, Jr.

[11] 4,136,964

[45] Jan. 30, 1979

[54] APPARATUS FOR SIMULTANEOUSLY MIXING AND CONVEYING PARTICULATE MATERIAL

[75] Inventor: George W. Swisher, Jr., Oklahoma City, Okla.

[73] Assignee: CMI Corporation, Oklahoma City, Okla.

[21] Appl. No.: 787,306

[22] Filed: Apr. 14, 1977

[51] Int. Cl.[2] ..... B28C 5/46

[52] U.S. Cl. ..... 366/23; 366/25; 366/40; 366/34; 366/271; 198/688

[58] Field of Search ..... 259/2, 97, 148, 145, 259/153, 155, 156, 157, 158, 159 R, 159 A, 160, 161, 164, 165, 178 R, 99, 114; 198/688, 698; 366/23, 24, 25

[56] References Cited

U.S. PATENT DOCUMENTS

| | | | |
|---|---|---|---|
| 2,743,911 | 5/1956 | Lejmark | 259/147 |
| 3,253,892 | 5/1966 | Brignac | 259/97 |
| 3,365,049 | 1/1968 | Raab | 198/688 |
| 3,378,171 | 4/1968 | Eaton | 259/157 |
| 3,484,083 | 12/1969 | Albertini | 259/155 |
| 3,561,907 | 2/1971 | Campbell | 198/688 |

*Primary Examiner*—Robert W. Jenkins
*Attorney, Agent, or Firm*—Dunlap, Codding & McCarthy

[57] ABSTRACT

Apparatus for simultaneously mixing and conveying particulate material, the apparatus comprising a housing having an input end and an output end disposed vertically higher than the input end, means for feeding the particulate material into the input end of the housing, a conveyor disposed within the housing and having a plurality of lifting surfaces provided with perforations therethrough so that a portion of the particulate material being lifted by each lifting surface descends through the perforations and is mixed with particulate material being lifted by lifting surfaces disposed therebelow, and means for discharging the mixed particulate material from the output end of the housing.

17 Claims, 8 Drawing Figures

APPARATUS FOR SIMULTANEOUSLY MIXING AND CONVEYING PARTICULATE MATERIAL

BACKGROUND OF THE INVENTION

1. Field of the Invention

This invention relates generally to improvements in mixing and conveying apparatus and, more particularly, but not by way of limitation, to an apparatus for simultaneously mixing and conveying particulate material.

2. Description of the Prior Art

Numerous types of apparatus have been proposed in the past for mixing various grades of aggregate, with or without liquid binding materials, to provide a substantially mixed aggregate material. In addition, numerous types of conveying apparatus have been proposed in the past to facilitate transfer of particulate material from one location at an operating site to another location of the same operating site. However, it is believed that it has not been heretofore proposed to provide an apparatus which efficiently combines the mixing and conveying functions by operating as a "inefficient" conveyor having perforated lifting surfaces which facilitate the mixing of the particulate material by "cascading" particulate material from one lifting surface to a lower lifting surface.

SUMMARY OF THE INVENTION

An apparatus for simultaneously mixing and conveying particulate material, the apparatus comprising a housing having an input end and an output end disposed vertically higher than the input end, means for feeding particulate material into the input end of the housing, a conveyor having a plurality of lifting surfaces provided with perforations therethrough so that a portion of the particulate material being lifted by each lifting surface descends through the perforations and is mixed with particulate material being lifted by lifting surfaces disposed therebelow, and means for discharging the mixed particulate material from the output end of the housing. The apparatus is particularly useful in recycling reclaimed asphalt mixes.

It is the primary object of the present invention to provide an apparatus for mixing particulate material while simultaneously conveying the particulate material from an input location to an output location.

Another object of the present invention is to provide a simple yet efficient apparatus for mixing asphaltic oil with particulate material in a heated environment to form a hot mix asphalt.

A further object of the present invention is to provide an efficient and economical apparatus for producing hot mix asphalt while minimizing the quantity of solid particle pollutants expelled into the surrounding atmosphere.

Yet another object of the present invention is to provide an apparatus for mixing an asphaltic oil emulsion with particulate material as the particulate material is being conveyed from an input location to an output location.

Still another object of the present invention is to provide an apparatus for mixing water with particulate material including cement as the particulate material is being conveyed from an input location to an output location.

Another object of the present invention is to provide a simple and economical apparatus for simultaneously mixing and conveying particulate material, with or without liquid binding material.

Other obejcts and advantages of the present invention will be evident from the following detailed description when read in conjunction with the accompanying drawings which illustrate embodiments of the present invention.

DESCRIPTION OF THE PREFERRED EMBODIMENT

Figure 1:
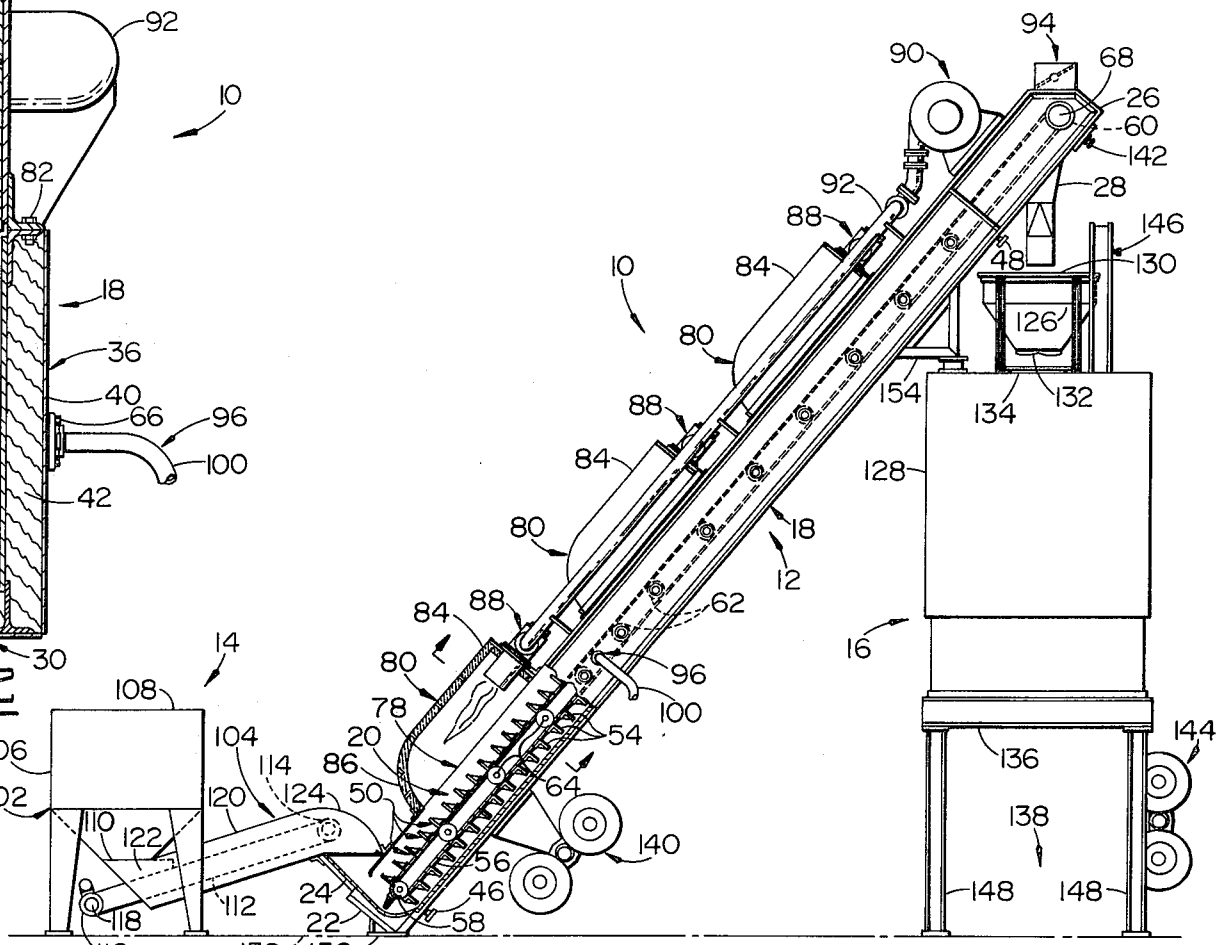
FIG. 1 is a partial cut-away, side elevational view of a mixing and conveying apparatus constructed in accordance with the preferred embodiment of the present invention.

Referring to the drawings in general, and to FIG. 1 in particular, shown therein and referred to hereinafter as the mixing and conveying apparatus 10, is an apparatus for simultaneously mixing and conveying particulate material constructed in accordance with the preferred embodiment of the present invention. More particularly, the mixing and conveying apparatus 10 is comprised of a mixer/conveyor 12, a feeder assembly 14, and a assembly 16. As will be made more apparent below, the mixing and conveying apparatus 10 is an extremely versatile assembly and may easily be configured to produce large quantities of such diverse products as hot or cold mix asphalt, and wet or dry concrete composition. By way of example, the mixing and conveying apparatus 10 has been illustrated in FIGS. 1 and 2, as well as described immediately below, in a hot mix asphalt configuration. Appropriate modifications which enable the mixing and conveying apparatus 10 to operate in alternative modes will be described in a later portion of the description of the preferred embodiment.

Figure 2:
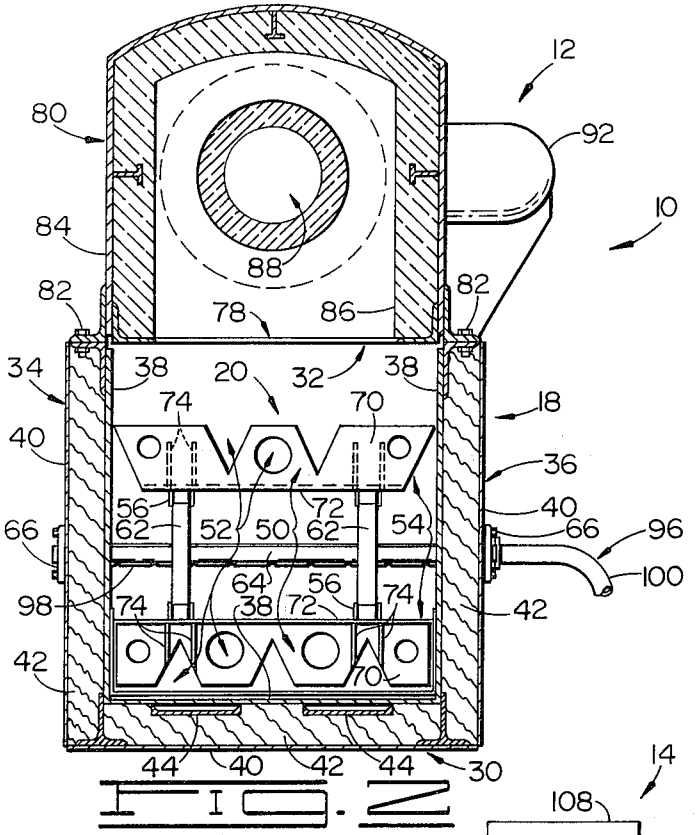
FIG. 2 is a cross sectional view of the mixing and conveying apparatus shown in FIG. 1, taken along the line 2—2 and showing two forms of lifting surfaces

As can be seen in FIGS. 1 and 2, the mixer/conveyor 14 is comprised primarily of a housing 18 and a conveyor 20. The housing 18 has an input end 22 provided with an input hopper 24, and an output end 26 provided with an output chute 28, the output end 26 being disposed vertically higher than the input end 22 thereof in the operating position of the mixer/conveyor 12. As can be seen most clearly in FIG. 2, the housing 18 has a generally rectangular cross-sectional shape formed from a lower wall section 30, an upper wall section 32, and a pair of opposite side wall sections 34 and 36. To facilitate retention of the heat generated during the operation of the mixing and conveying apparatus 10 in the production of hot mix asphalt, each of the wall sections 30, 34, and 36, includes an inner wall panel 38, an outer wall panel 40, and a layer of high temperature insulating material 42 disposed between the inner and outer wall panels 38 and 40, respectively. In order to assure that the temperature of the inner wall panel 38 of the lower wall section 30 is sufficiently high to assure efficient operation in the hot mix asphalt mode, one or more manifolds 44 may be interposed between the layer of insulating material 42 and the inner wall panel 38 of the lower wall section 30 to facilitate the circulation of suitable heated fluids or gases therethrough via appropriately positioned inlet and outlet conduit connectors 46 and 48, respectively (see FIG. 1).

The conveyor 20 is disposed within the housing 18, from the input end 22 to the output end 26 thereof, and is constructed to lift particulate material fed by the feeder assembly 14 via the input hopper 24 into the input end 22 of the housing 18, upwardly from the input end 22 thereof to the output end 26 thereof for discharge via the output chute 28 into the storage assembly 16. More particularly, the comveyor 20 is comprised primarily of a plurality of lifting surfaces 50 having one or more perforations 52 extending therethrough so that at least a portion of the particulate material being lifted by each lifting surface 50 descends through the perforations 52 under the influence of gravity, and is mixed with particulate material being lifted by lifting surfaces 50 disposed generally vertically therebelow, In the particular embodiment shown in FIGS. 1 and 2, the conveyor 20 is of the continuous drag chain type, wherein a plurality of drag flights 54 (each forming one of the lifting surfaces 50) are connected to; and form a portion of, a pair of continuous drag chains 56. Each drag chain 56 is disposed around and extends between a tail pulley 58 connected to the housing 18 adjacent to the input end 22 thereof, and a head pulley 60 connected to the housing 18 adjacent the output end 26 thereof, with a plurality of idler pulleys 62 being positioned along and providing support for the length of the drag chain 56. As can be seen most clearly in FIG. 2, each of the pulleys 58, 60 and 62, is axially connected to the respective axles 64 journalled through associated flange bearings 66 connected to the side wall sections 34 and 36 of the housing 18. Both of the head pulleys 60 are connected to a drive motor 68 of conventional construction which rotates the head pulleys 60, thereby moving the drag chains 56 so that each drag flight 54 will tend to "scoop up" a quantity of the particulate material contained in the input end 22 of the housing 18, and draw the material upwardly along the inner wall panel 38 of the lower wall section 30 for subsequent discharge from the output end 26 of the housing 18 via the output chute 28. However, in view of the perforations 52 extending through the lifting sufaces 50 formed by the drag flights 54, at least a portion of the particulate material initially "scooped up" will fall through the perforations 52 during transit of the drag flights 54 from the input end 22 to the output end 26 of the housing 18, and will subsequently be mixed with the particulate material being lifted by lifting surfaces 50 disposed generally vertically therebelow.

As may be seen most clearly in FIGS. 2 through 5, each of the drag flights 54 is formed from a generally rectangular plate 70 which is connected to, and extends perpendicularly from, respective links of the drag chains 56 via a mounting plate 72. A plurality of triangular gussets 74 may be connected between the plate 70 and the mounting plate 72 to increase the rigidity of the plate 70 if desired. Of course, a single drag chain 56 may be sufficient in some applications, while in some other applications, flexible cables may be advantageously employed in place of the drag chains 56.

From the various alternate embodiments shown in FIGS. 2, 3, 4 and 5, it can be seen that the perforations 52 extending through the drag flights 54 may be of any desired shape (such as the triangular perforations 52 shown in FIGS. 2 and 4, the circular perforations 52 shown in FIG. 2, the rectangular perforations 52 shown in FIGS. 3 and 4, and the generally oval perforations 52 shown in FIG. 5), as well as being provided in any number and orientation. However, it has been determined to be most advantageous to utilize at least two variations in the size and position of the perforations 52 so that the perforations 52 through each of the drag flights 54 are generally out of alignment with the perforations 52 through adjacent drag flights 54, thereby significantly impoving the mixing action by imparting a tumbling motion to the particulate material as it cascades between adjacent drag flights 54. It has also been determined to be highly desirable to provide at least some of the drag flights 54 with a continuous outer edge 76 (see FIG. 5) so as to provide a periodic scraping of the inner wall panel 38 of the lower wall 30 of the housing 18. The provision of a continuous outer edge 76 on some of the drag flights 54 also assures that at least some of the particulate material will be lifted from the input end 22 to the output end 26 of the housing 18 in each "cycle" of the conveyor 20. This latter feature also enables the mixing and conveying apparatus 10 to be "self-cleaning", that is, upon deactuation of the feeder assembly 14, the mixer/conveyor 12 will be capable of conveying and discharging all of the particulate material contained therein after an appropriate number of "cycles" of the conveyor 20.

As can be seen most clearly in FIG. 2, the housing 18 of the mixer/conveyor 12 is provided with at least one opening 78 through the upper wall section 32 thereof to facilitate the introduction of heated exhaust gases produced by an associated burner assembly 80 connected thereto via such conventional means as the bolts 82. Each burner assembly 80 is comprised of a housing 84 having suitable refractory material 86 lining the inner surfaces thereof, and an oil or gas fired burner 88 of conventional construction. Hydrocarbon fuel for the burner 88 will be supplied in a conventional manner from a suitable source of fuel (not shown), while combustion-supporting air is preferably supplied by a blower assembly 90 via an air duct 92. An adjustable draft, exhaust damper assembly 94 should also be connected to the output end 26 of the housing 18 to facilitate control of the pressure in the mixer/conveyor 12 as well as to direct the heated exhaust gases exiting from the housing 18. As will be clear to those skilled in the art, the size, number and construction of the burner assemblies 80 may be widely varied to suit individual operating requirements.

In the production of hot mix asphalt, it is normally necessary to mix the particulate material, commonly referred to as aggregate, with a suitable liquid binding material, such as heated asphaltic oil. Accordingly, the mixer/conveyor 12 is provided with a sprayer assembly 96 including a sprayer bar 98 disposed within the housing 18 generally between the input end 22 and the output end 26 thereof, and a supply conduit 100 connected between the sprayer bar 98 and a suitable source of the liquid binding material (not shown). The binding material thus injected into the medial portion of the housing 18 will then automatically be mixed with the particulate material which has been heated via the burner assemblies 80 to form a hot mix asphalt for discharge from the output end 26 of the housing 18 into the storage assembly 16 via the output chute 28. Of course, one or more additional sprayer bars 98 may be provided, if desired, to spread the injection of the binding material more evenly over the length of the housing 18.

The feeder assembly 14 is comprised primarily of an input storage unit 102 and a conveyor unit 104. In the configuration shown in FIG. 1, the input storage unit 102 consists of a single storage bin 106 having an input end 108 through which particulate material is placed therein, and an output end 110 through which the particulate material is discharged onto the conveyor unit 104 at a rate determined by the size of the opening therethrough. The conveyor unit 104 includes a continuous-belt conveyor 112 disposed around, and extending between, a tail pulley 114 disposed generally vertically above the input end 22 of the housing 18, and a head pulley 116 disposed generally vertically below the output end 110 of the storage bin 106. A drive motor 118 is connected to the head pulley 116 in a conventional manner to drive the conveyor 112. Preferably, a shroud assembly 120 is disposed around the conveyor 112 with an input chute portion 122 connected to the output end 110 of the storage bin 106, and an output chute portion 124 connected to the input hopper 24 on the input end 22 of the housing 18. As will be clear to those skilled in the art, the storage unit 102 will cooperate with the conveyor unit 104 to feed particulate material from the storage unit 102 into the input end 22 of the housing 18 at a rate determined by the size of the opening through the output end 110 of the storage bin 106, and the rate of travel of the conveyor 112.

The feeder assembly 14 shown in FIG. 1 has been determined to be particularly desirable when the particulate material to be used in the production of the hot mix asphalt consists of previously manufactured and laid asphalt paving material which has been reduced to form recyclable aggregate, either through modern roadway planing methds or by conventional crushers or the like. In this mode of operation, not only is the quantity of liquid binding material required to be injected into the housing via the sprayer assembly 96 minimized, but also the amount of heat required to be introduced into the housing 18 via the burner assemblies 80 will also be minimized, since maximum operating temperatures on the order of 200° to 300° F. should be sufficient in most circumstances.

The storage assembly 16 is comprised primarily of a slug feeder 126 and a surge bin 128. The slug feeder 126 is disposed with an input end 130 thereof generally vertically below the output chute 28 of the mixer/conveyor 12, and an output end 132 thereof disposed generally vertically above an input end 134 of the surge bin 128. The slug feeder 126 is constructed in a well manner to temporarily retain the mixed particulate material being discharged from the mixer/conveyor 12, before feeding the retained "slug" into the surge bin 128, thereby preserving the particle size homogeneity. The surge bin 128 is constructed in a conventional manner to receive the "slugs" of mixed particulate material from the slug feeder 126 via the input end 134 thereof, and discharge desired quantities of the mixed particulate material via an output end 136 thereof into suitable transport vehicles (not shown) upon the arrival thereof at a loading station 138 disposed generally vertically below the output end 136 of the surge bin 128.

To facilitate transportation of the mixing and conveying apparatus 10, the mixer/conveyor 12 is provided with a tandem wheel assembly 140 adjacent the input end 22 of the housing 18, and a king pin 142 adjacent the output end 26 of the housing 18. In a similar manner, the storage assembly 16 is provided with a tandem wheel assembly 144 adjacent the output end 136 of the surge bin 128, and a king pin 146 adjacent the input end 130 of the slug feeder 126. Upon arrival at a desired operating site, the storage assembly 16 may be disposed in a generally vertical position on a plurality of support legs 148 extending from the output end 136 of the surge bin 128 via a conventional crane or the like. Similarly, the mixer/conveyor 12 may be placed in the inclined operating position via a crane or the like. To increase the stability of the mixer/conveyor 12 in the operating position thereof, a butt plate 150 may be connected to the input end 22 of the housing 18 to provide a stable interface between the mixer/conveyor 12 and the adjacent ground surface 152, while a support bracket 154 may be connected to the housing 18 adjacent the output end 26 thereof to provide a stable connection between the mixer/conveyor 12 and the storage assembly 16. Of course, the feeder assembly 14 shown in FIG. 1 is of sufficiently small size to be transported via conventional flat bed trailers or the like.

As an alternative to the hot mix asphalt configuration described above, the mixing and conveying apparatus 10 may be easily configured to facilitate production of cold mix asphalt merely by supplying a suitable asphaltic oil emulsion to the sprayer assembly 96 for injection into the medial portion of the housing 18, and by disabling the operation of the burner assemblies 80 either by shutting them off or by removing the burner assemblies 80 entirely and closing the openings 78 through the upper wall section 32 of the housing 18 via suitable cover plates (not shown). In a similar manner, the mixing and conveying apparatus 10 may be configured to facilitate production of concrete compositions by disabling the operation of the burner assemblies 80 as described immediately above, and by loading the feeder assembly 14 with suitable grades of particulate material in combination with cement. When it is desired to produce a wetted concrete composition, such as may be appropriate when the mixing and conveying apparatus 10 is employed to supply a major concrete road building operation, the wetting agent, usually water, may be introduced into the housing 18 via one or more of the sprayer bars 98 of the sprayer assembly 96.

In many situations, it is highly desirable to be able to blend various grades of particulate material to adapt to changing job specifications. In such a case, a more versatile and flexible feeder assembly 14*a*, such as that shown in FIG. 6, may be provided in place of the feeder assembly 14 shown in FIG. 1. The feeder assembly 14*a* is comprised primarily of an input storage unit 102*a* and a conveyor unit 104*a*. The input storage unit 102*a* consists of a plurality of storage bins 106*a*, each having an input end 108*a* through which particulate material of a specified grade is placed therein, and an output end 110*a* through which the particulate material is discharged onto an adjacent portion of the conveyor unit 104a at a rate determined by an associated feeder control unit 156. The conveyor unit 104a includes a continuous-belt conveyor 112a extending beneath the output ends 110a of each of the storage bins 106a, between a tail pulley 114a disposed adjacent the storage bin 106a farthest from the mixer/conveyor 12, and a head pulley 116a provided with the drive motor 118a and disposed generally vertically above the input end 22 of the housing 18.

To facilitate efficient operation of the mixing and conveying apparatus 10, a conveyor belt weighing unit 158 of conventional construction is shown connected to the folding boom extension 160 of the conveyor 104a, to provide an accurate indication of the quantity of particulate material being fed by the feeder assembly 14a into the mixer/conveyor 12. A suitable wheel assembly 16a, as well as a king pin 164, have also been provided to facilitate transportation of the feeder assembly 14a between operating sites, while a plurality of pivoting support legs 166 have been provided to support the feeder assembly 14a in the operating position.

Figures 3, 4, 5, 6, 7, 8, 9:
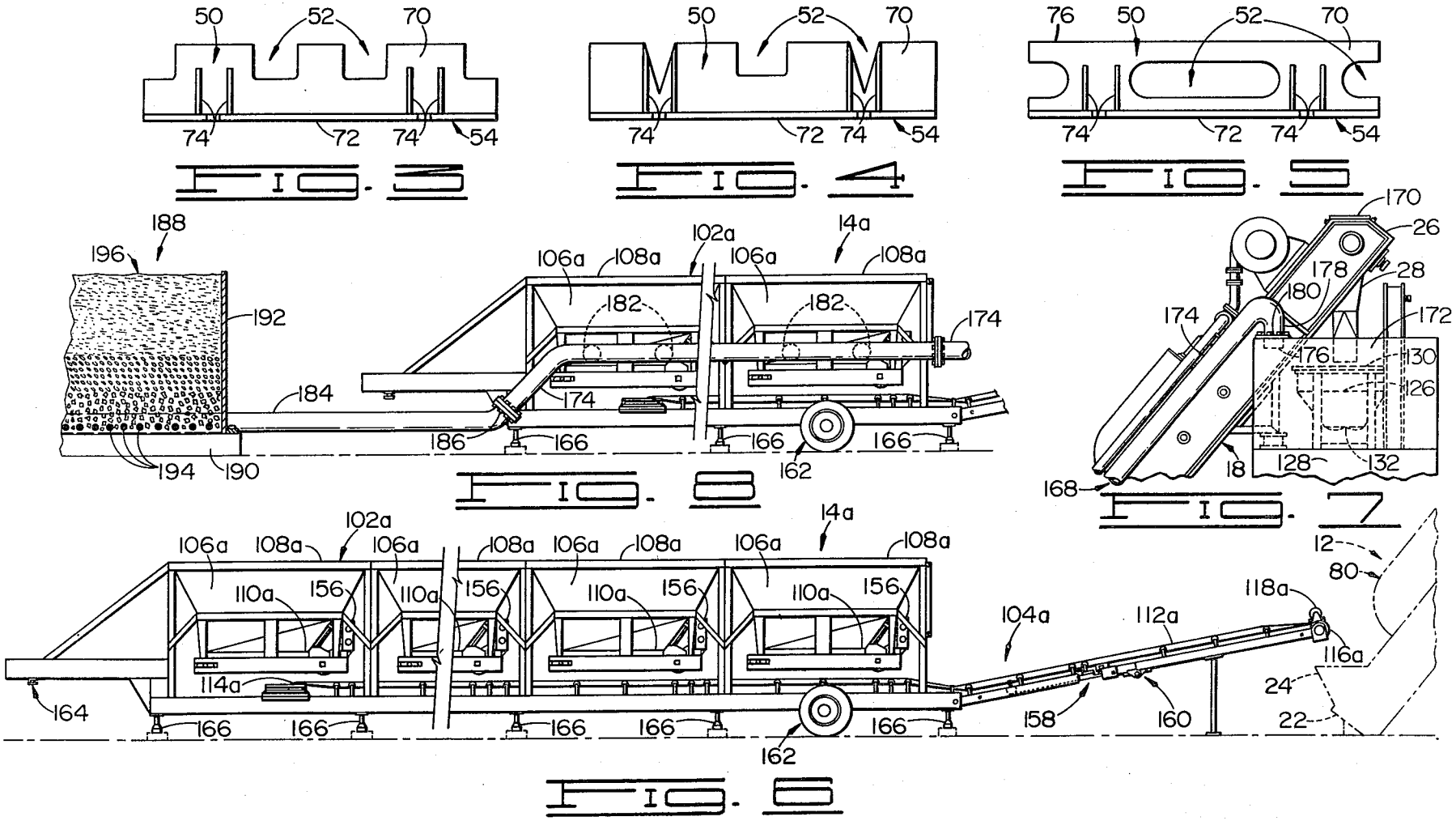
FIG. 3 is a detailed view of another alternate form of lifting surface suitable for use with the mixing and conveying apparatus shown in FIG. 1.
FIG. 4 is yet another alternate form of lifting surface suitable for use with the mixing and conveying apparatus shown in FIG. 1.
FIG. 5 is still another form of lifting surface suitable for use with the mixing and conveying apparatus shown in FIG. 1.
FIG. 6 is a side elevational view of an alternate form of apparatus for feeding particulate material into the input end of the mixing and conveying apparatus shown in phantom.
FIG. 7 is a partial side elevational view of a portion of a recirculating exhaust system for use with an alternate form of the mixing and conveying apparatus shown in FIG. 1.
FIG. 8 is a partial side elevational view of another portion of the recirculating exhaust system shown in FIG. 7.

Shown in FIGS. 7 and 8 is a recirculating exhaust system 168 designed to efficiently and economically minimize the quantity of solid particle pollutants expelled into the surrounding atmosphere as a result of operating the mixing and conveying apparatus 10 in the hot mix asphalt mode. In addition, the exhaust system 168 reclaims a large percentage of the heat present in the expelled exhaust gases by preheating the particulate material before it is fed into the mixer/conveyor 12 and by maintaining a heated environment around the mixed particulate material after it is discharged from the mixer/conveyor 12. As can be seen in FIG. 7, a cover plate 170 is connected to the output end 26 of the housing 18 in place of the exhaust damper assembly 94, while a hood 172 is connected between the output chute 28 of the housing 18 and the input end 134 of the surge bin 128, to enclose the slug feeder 128. Thus, heated exhaust gases exiting from the output end 26 of the housing 18 via the output chute 28 will be introduced into the interior of the surge bin 128, thereby maintaining a heated environment around the mixed particulate material being temporarily retained therein.

To facilitate flow of the heated exhaust gases into and through the surge bin 128, an exhaust conduit 174 is disposed generally alongside the mixer/conveyor 12 with an input end 176 thereof connected through the top 178 of the hood 172 in a substantially airtight manner via a suitable coupling 180. Another portion of the conduit 174 is connected to exhaust outlets 182 provided in the lower portion of each of the storage bins 106a of the storage unit 102a (see FIG. 8). Alternatively, the manifolds 44 may be employed to convey the heated exhaust gases from the interior of the hood 172 via the outlet conduit connector 48, with the inlet conduit connector 46 being connected in an appropriate manner to the portion of the conduit 174 connected to the exhaust outlets 182.

Preferably, suitable exhaust control dampers (not shown) are provided in conjunction with each of the exhaust outlets 182 to limit, or, if desired, totally preclude, passage of the heated exhaust gases into and through the particulate material in each of the respective storge bins 106a. As will be clear to those skilled in the art, abrupt drop in velocity of the exhaust gases upon introduction thereof into the storage bins 106a, as well as the convoluted flow paths through the particulate material, will induce precipitation of substantially all of the solid particle pollutants entrained in the exhaust gases. Simultaneously, excess heat remaining in the exhaust gases will be transferred to the particulate material, thereby effectively pre-heating the particulate material prior to the introduction thereof into the mixer/conveyor 12.

In those situations where it may be deemed undesirable to pass the exhaust gases through the particulate material, as where the moisture content in the exhaust gases may be excessively high, an extension conduit 184 may be connected between the exhaust conduit 174 via a suitable connector 186, and a particulate material filter bed 188 retained on a slab base 190 via a retaining wall 192, so that the exhaust gases may be effectively filtered upon exiting through a plurality of perforations 194 provided in the portion of the extension conduit 184 disposed beneath the aggregate material 196 forming the filter bed 188. As will be clear to those skilled in the art, the aggregate material 196 may be deposited in the filter bed 188 in a plurality of layers having successively smaller particle size, thereby increasing the effectiveness and efficiency of the filtering operation.

Changes may be made in the construction and the arrangement of the parts or the elements of the various embodiments as disclosed herein without departing from the spirit and scope of the invention as defined in the following claims.

What is claimed is:

1. Apparatus for simultaneously mixing and conveying a particulate material, comprising:

a housing having an input end and an output end disposed vertically higher than the input end;

means for feeding particulate material into the input end of the housing;

conveyor means disposed within the housing and extending from the input end to the output end thereof for lifting the particulate material from the input end to the output end of the housing, the conveyor means including a plurality of lifting surfaces having perforations therethrough, whereby a portion of the particulate material being lifted by each lifting surface descends through the perforations and is mixed with particulate material being lifted by lifting surfaces disposed therebelow;

means for discharging the mixed particulate material from the output end of the housing;

burner means connected to the housing for heating the particulate material in the housing; and, means for injecting asphaltic oil into the medial portion of the housing, whereby the asphaltic oil is mixed with the heated particulate material to form a hot mix asphalt.

2. The apparatus of claim 1 further defined to include:

storage means cooperating with the means for discharging the mixed particulate material from the output end of the housing for receiving and temporarily retaining the discharged mixed particulate material.

3. The apparatus of claim 2 further defined to include:

recirculating exhaust means connected between the housing and the storage means for conducting the heated exhaust gases exiting from the housing into the storage means to maintain a heated environment around the mixed particulate material retained therein.

4. The apparatus of claim 1 wherein the means for feeding the particulate material is further defined to include:

an input storage unit having a storage bin containing particulate material, the input storage unit discharging the particulate material at a predetermined rate; and, a conveyor unit having one end disposed generally vertically above the input end of the housing and one other portion disposed generally vertically below the storage unit, the conveyor unit feeding the particulate material discharged from the storage unit into the input end of the housing at a predetermined rate.

5. The apparatus of claim 4 further defined to include:

recirculating exhaust means connected between the housing and the input storage unit for conducting the heated exhaust gases exiting from the housing into the storage bin of the input storage unit to preheat the particulate material contained therein 6. The apparatus of claim 1 further defined to include:

exhaust means having an aggregate filter bed connected to the housing for filtering the exahust gases exiting from the housing through the aggregate filter bed to remove substantially all of the solid particle pollutants entrained therein.

7. Apparatus for simultaneously mixing and conveying particulate material, comprising:

a housing having an input end and an output end disposed vertically higher than the input end;

means for feeding particulate material into the input end of the housing;

conveyor means disposed within the housing and extending from the input end to the output end thereof for lifting the particulate material from the input end to the output end of the housing, the conveyor means including a plurality of lifting surfaces having perforations therethrough, whereby a portion of the particulate material being lifted by each lifting surface descends through the perforations and is mixed with particulate material being lifted by lifting surfaces disposed therebelow;

means for discharging the mixed particulate material from the output end of the housing; and, means for injecting an asphaltic oil emulsion into the medial portion of the housing, whereby the asphaltic oil emulsion is mixed with the particulate material to form a cold mix asphalt.

8. The apparatus of claim 1 wherein the housing is further characterized as including insulating means for retaining the heat generated by the burner means.

9. The apparatus of claim 8 wherein the housing is further characterized as including means for circulating heated fluids through a portion of the housing.

10. Apparatus for simultaneously mixing and conveying particulate material, comprising:

a housing having an input end and an output end disposed vertically higher than the input end;

means for feeding particulate material into the input end of the housing;

conveyor means disposed within the housing and extending from the input end to the output end thereof for lifting the particulate material from the input end to the output end of the housing, the conveyor means including a plurality of lifting surfaces having perforations therethrough, whereby a portion of the particulate material being lifted by each lifting surface descends through the perforations and is mixed with particulate material being lifted by lifting surfaces disposed therebelow;

means for discharging the mixed particulate material from the output end of the housing; and, storage means cooperating with the means for discharging the mixed particulate material from the output end of the housing for receiving and temporarily retaining the discharged mixed particulate material, wherein the storage means are further defined to include:

a slug feeder disposed vertically below the output end of the housing and cooperating with the means for discharging the mixed particulate material from the output end of the housing, the slug feeder temporarily retaining the mixed particulate material discharged from the housing before discharging the temporarily retained mixed particulate material; and, a surge bin disposed vertically below the slug feeder, the surge bin receiving the mixed particulate material discharged from the slug feeder and discharging the mixed particulate material in predetermined quantities.

11. Apparatus for simultaneously mixing and conveying particulate material comprising:

a housing having an input end and an output end disposed vertically higher than the input end;

means for feeding particulate material into the input end of the housing;

drag chain conveyor means disposed within the housing and extending from the input end to the output end thereof for lifting the particulate material from the input end to the output end of the housing, the drag chain conveyor means including a plurality of drag flights having perforations therethrough, wherein the perforations through each of the drag flights are generally out of alignment with the perforations through adjacent drag flights, whereby a portion of the particulate material being lifted by each drag flight descends through the perforations and is mixed with particulate material being lifted by drag flights disposed therebelow; and, means for discharging the mixed particulate material from the output end of the housing.

12. The apparatus of claim 11 wherein the housing is further characterized as having a wheel assembly adjacent the input end thereof and a king pin adjacent the output end thereof, the wheel assembly and the king pin facilitating transportation of the housing.

13. The apparatus of claim 11 wherein at least some of the perforations are triangular in shape.

14. The apparatus of claim 11 wherein at least some of the perforations are circular in shape.

15. The apparatus of claim 11 wherein at least some of the perforations are rectangular in shape.

16. The apparatus of claim 11 wherein at least some of the perforations are oval in shape.

17. Apparatus for simultaneously mixing and conveying particulate material comprising:

a housing having an input end and an output end disposed vertically higher than the input end;

means for feeding particulate material into the input end of the housing;

drag chain conveyor means disposed within the housing and extending from the input end to the output end thereof for lifting the particulate material from the input end to the output end of the housing, the drag chain conveyor means including a plurality of drag flights having perforations therethrough, wherein at least some of the drag flights have a continuous outer edge providing a periodic scraping of a portion of the housing, whereby a portion of the particulate material being lifted by each drag flight descends through the perforations and is mixed with particulate material being lifted by drag flights disposed therebelow; and, means for discharging the mixed particulate material from the output end of the housing.

* * * * *

UNITED STATES PATENT OFFICE

CERTIFICATE OF CORRECTION

Patent No. 4,136,964 Dated January 30, 1979

Inventor(s) George W. Swisher, Jr.

It is certified that error appears in the above-identified patent and that said Letters Patent are hereby corrected as shown below:

Column 2, line 48, insert --storage-- between "a" and "assembly".

Column 3, line 26, "comveyor" should be --conveyor--.

Column 5, line 63, insert --known-- between "well" and "manner".

Signed and Sealed this

*First* Day of *May 1979*

[SEAL]

*Attest:*

RUTH C. MASON
*Attesting Officer*

DONALD W. BANNER
*Commissioner of Patents and Trademarks*